US005713430A

United States Patent [19]

Cohen

[11] Patent Number: 5,713,430

[45] Date of Patent: Feb. 3, 1998

[54] DEVICE FOR TREATING EXTERIOR SURFACES FOR STRUCTURES

[76] Inventor: Schachar Cohen, 19/15 Ben David, Petah Tikva, Israel

[21] Appl. No.: 609,815

[22] Filed: Feb. 29, 1996

[51] Int. Cl.[6] ..... E04G 3/14

[52] U.S. Cl. ..... 182/37; 182/36; 182/142

[58] Field of Search ..... 182/36, 37, 82, 182/142, 147; 248/237

[56] References Cited

U.S. PATENT DOCUMENTS

| | | | |
|---|---|---|---|
| 271,809 | 2/1883 | Dearborn | 182/36 X |
| 447,898 | 3/1891 | Nygren | 182/37 X |
| 861,707 | 7/1907 | Cain | 182/37 X |
| 868,117 | 10/1907 | Olney | 182/37 |
| 1,437,920 | 12/1922 | Stephens | 182/37 X |
| 1,470,388 | 10/1923 | Pitou | 182/37 X |
| 1,776,950 | 9/1930 | Marcinauskas | 182/37 |
| 1,971,294 | 8/1934 | Bunker | 182/37 X |
| 3,347,339 | 10/1967 | Coole | 182/36 X |
| 3,854,550 | 12/1974 | Shingler | 182/36 |
| 4,096,922 | 6/1978 | Fisher | 182/36 |
| 4,234,055 | 11/1980 | Beeche | 182/142 X |
| 4,270,628 | 6/1981 | Anderson | 182/37 X |
| 5,065,838 | 11/1991 | Finley | 182/142 X |
| 5,341,898 | 8/1994 | Baziuk | 182/142 |
| 5,343,979 | 9/1994 | Goto | 182/147 |

*Primary Examiner*—Leslie A. Braun
*Assistant Examiner*—Richard M. Smith
*Attorney, Agent, or Firm*—Mark M. Friedman

[57] ABSTRACT

A device for vertical as well as horizontal snapling along and across an exterior surface of a structure such as a building comprising a substantially horizontal guiding member being secured onto the edge of the roof of the structure, a horizontally translating first pulley being translatably attached to the guiding member, the first pulley being horizontally translatable relative to the guiding member, the first pulley including a first attachment and, a snapling equipment attached to the first attachment of the first pulley.

13 Claims, 1 Drawing Sheet

DEVICE FOR TREATING EXTERIOR SURFACES FOR STRUCTURES

FIELD AND BACKGROUND OF THE INVENTION

The present invention relates to a device for treating exterior surfaces of structures and, more particularly, to a device enabling vertical as well as horizontal safe snapling along and across the exterior of buildings.

Tall buildings and scrapers are quite commonplace, especially in heavily populated areas. The external surfaces of such buildings must occasionally be treated for aesthetic and/or functional reasons. For example, it is desirable to periodically clean the outside surfaces of the building windows, which windows often form an integral part of the building exterior and cannot be accessed from within the building. It may also be desirable to clean surfaces other than the windows. Similarly, it may be desired to paint or otherwise coat portions of the exterior surface of buildings, or install/fix various external elements such as lighting bodies, signs, etc.

A number of techniques are currently used in order to gain access to buildings exterior for the purpose of effecting any of the above-mentioned treatments and others. A very small fraction of buildings are designed with external access ways surrounding each floor which can accommodate a worker. However, the vast preponderance of buildings, for reasons of cost and/or architectural aesthetic considerations, do not feature such access ways.

To treat the external surfaces of buildings lacking external access ways, one normally relies on scaffolding capable of accommodating one or more workers. For large undertakings, such as the repainting of the exterior of a building, weeks may be required to erect the necessary scaffolding.

For smaller jobs a scaffold platform may be supported by cables which are attached to an appropriate securing device secured at the roof of the building. A motor located on the roof or on the platform is used to raise and lower the scaffold platform. The securing device can be moved as necessary to the appropriate location on the roof so as to allow access of workers on the platform to the precise portion of the building exterior to be treated. Some buildings feature a series of permanently installed securing devices located at desired locations along the roof, which obviates the need to move and redeploy a mobile anchoring device.

Alternatively, a snapling equipment is used by a worker to locate himself at various locations relative to the exterior surface of the treated building. The snapling equipment typically includes a securing device protruding from the roof of the building and a cable system and locking mechanisms permitting the worker to vertically locomote himself up and down along the exterior of the building, securely lock the cable system from further movement when he has reached a desired location and perform treatment at that location.

For many applications the snapling approach is preferred over the above described scaffold approaches due to the time, labor and cost involved in setting up ground or cable supported scaffolds. Nevertheless, from the above description it is clear that the snapling approach has a major drawback since it restricts the worker to vertical locomotion, thus only a narrow longitudinal stripe of the building can be treated at a time, thereafter the snapling equipment is to be secured at a different location on the roof before treating additional portions of the building's exterior. This in turn hampers the continuity and thus extends the time and increases the effort required to complete the treatment of the building.

There is thus a widely recognized need for, and it would be highly advantageous to have, a device enabling vertical as well as horizontal safe snapling along and across the exterior of buildings.

SUMMARY OF THE INVENTION

According to the present invention there is provided a device for vertical as well as horizontal snapling along and across an exterior surface of a structure such as a building.

According to further features in preferred embodiments of the invention described below, the device comprising (a) a substantially horizontal guiding member being secured onto the edge of the roof of the structure, the guiding member having a first end and a second end; (b) a horizontally translating first pulley being translatably attached to the guiding member, the first pulley being horizontally translatable relative to the guiding member, the first pulley including a first attachment; and (c) a snapling equipment attached to the first attachment of the first pulley.

According to still further features in the described preferred embodiments the device further comprising (d) at least two L-shape supporters being connected or integrally formed with the guiding member, each of the at least two supporters having a vertical arm and a horizontal arm, the vertical arm being vertically disposed against the exterior surface of the structure, the horizontal arm being horizontally disposed on the roof of the structure; (e) at least two press forming mechanisms, each of the at least two press forming mechanisms being attached or integrally formed with one of the at least two horizontal arms of one of the supporters; and (f) at least two straps, each of the straps having a first end and a second end, the first ends being connected to the guiding member and the second ends being connected to the roof element, such that when an object is connected to the snapling equipment, each of the at least two straps applies a vectorial vertical press onto the at least two press forming mechanism and thus vertically presses the at least two horizontal arms onto the roof of the structure, thus securing the guiding member onto the edge of the roof.

According to still further features in the described preferred embodiments the device further comprising (g) a security cable being connected at both ends to the guiding member; and (h) a horizontally translating second pulley being translatably attached to the security cable, the second pulley being horizontally translatable relative to the security cable, the second pulley including a second attachment for securely attaching the snapling equipment thereto.

According to still further features in the described preferred embodiments the guiding member is made of at least two guiding segments securely connected to one another.

According to still further features in the described preferred embodiments the secure connection is by a secured quick release mechanism.

According to still further features in the described preferred embodiments each of the at least two press forming mechanisms have a shape selected from the group consisting of a triangle, an arc, a rectangle and a pole.

According to still further features in the described preferred embodiments each of the horizontal arms of the at least two L-shape supporters has a rough roof facing surface.

According to still further features in the described preferred embodiments each of the at least two press forming mechanisms has a strap securing mechanism.

According to still further features in the described preferred embodiments the strap securing mechanism is selected from the group consisting of an oval ring, a rectangular ring, an open oval ring and an open rectangular ring.

According to still further features in the described preferred embodiments each of the at least two straps is selected from the group consisting of a cable, a wire, a rope and an adjustable length strap.

According to still further features in the described preferred embodiments the guiding member includes at least two strap attachment mechanisms for each is for attaching the first end of one of the at least two straps.

According to still further features in the described preferred embodiments the strap attachment mechanisms is selected from the group consisting of a ring attached to the guiding member, a hook attached to the guiding member and a hole formed in the guiding member.

According to still further features in the described preferred embodiments the ring and the hole have a rectangular shape.

According to still further features in the described preferred embodiments the guiding member includes a first stoppage mechanism located at the first end of the guiding member and a second stoppage mechanism located at the second end of the guiding member for stopping the first pulley, the stoppage mechanisms are for stopping the first pulley from sliding off the guiding member.

The present invention successfully addresses the shortcomings of the presently known configurations by providing a simple and safe device enabling vertical as well as horizontal snapling along and across an exterior surface of a structure.

BRIEF DESCRIPTION OF THE DRAWINGS

The invention herein described, by way of example only, with reference to the accompanying drawings, wherein.

DESCRIPTION OF THE PREFERRED EMBODIMENTS

The present invention is of a device for treating exterior surfaces of structures such as buildings which can be used for safe vertical as well as horizontal snapling along and across the exterior of buildings. Specifically, the present invention can be used to treat the exterior of buildings for aesthetic and/or functional reasons.

The principles and operation of a device for treating exterior surfaces of structures according to the present invention may be better understood with reference to the drawings and accompanying descriptions.

Figure 1:
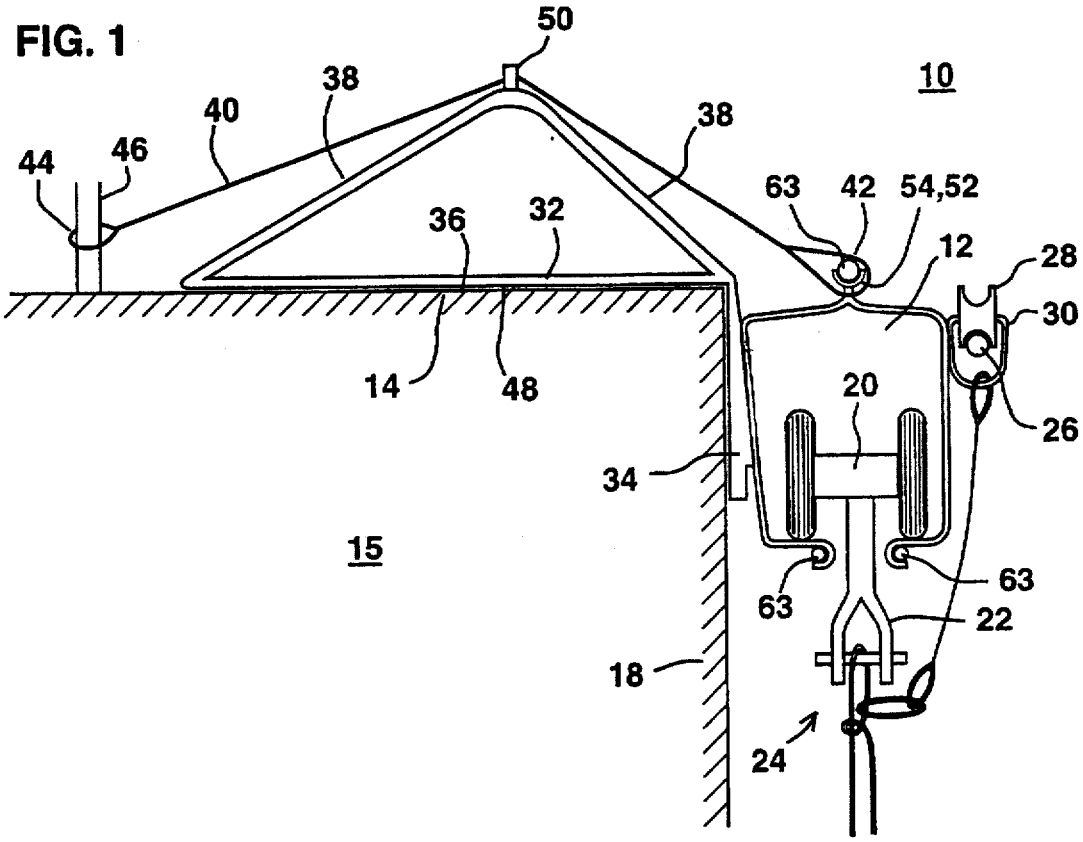
FIG. 1 is a cross section through a device for vertical as well as horizontal snapling along and across an exterior surface of a structure according to the present invention when installed on a roof of a building.
Figure 2:
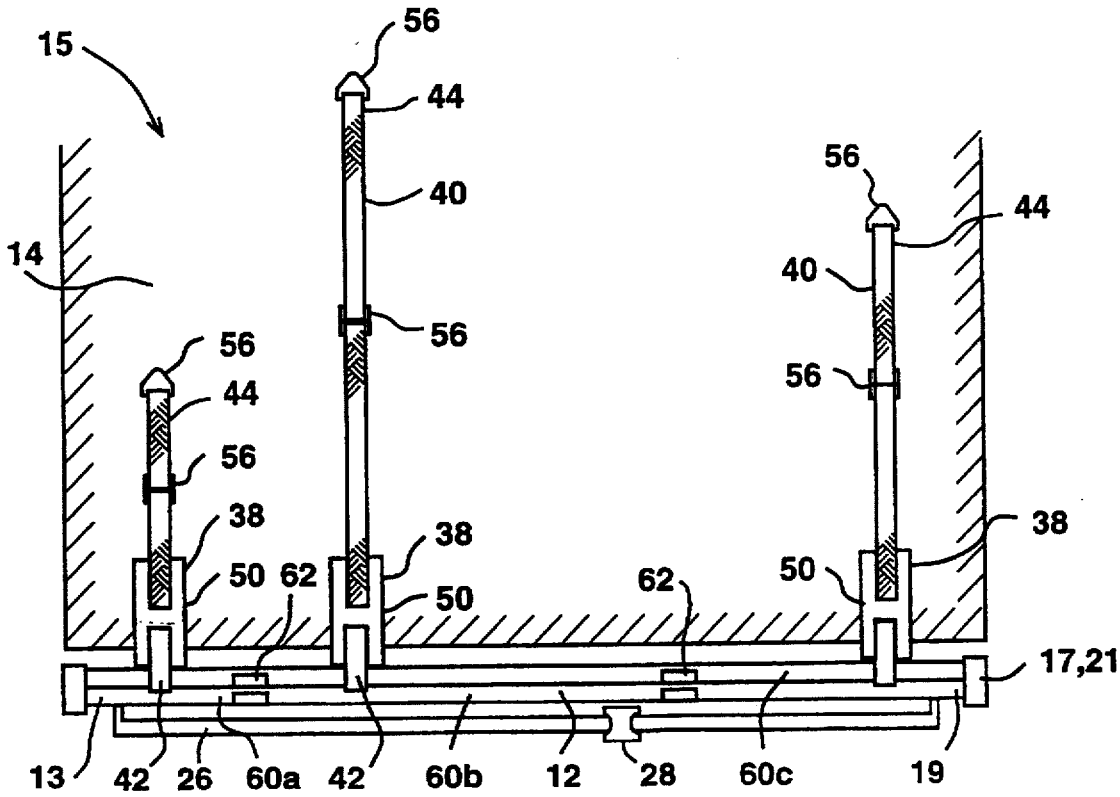
FIG. 2 is a top view of a device for vertical as well as horizontal snapling along and across an exterior surface of a structure according to the present invention when installed on a roof of a building.

Referring now to the drawings, FIGS. 1 and 2 illustrate the basic components of the device for treating exterior surfaces 18 (e.g., a wall) of structures 15 according to the present invention, referred to hereinbelow as device 10. Thus, in its minimal configuration, device 10 includes a substantially horizontal guiding member 12 which is secured onto the edge (e.g., close to the edge, and near wall 18, as shown in FIG. 1) of a roof or a roof banquet 14 of a structure 15 such as a building. Further according to its minimal configuration, device 10 further includes a horizontally translating first pulley 20 translatably attached to guiding member 12. Pulley 20 is horizontally translatable relative to guiding member 12 and includes a first attachment 22 for attaching a snapling equipment 24 thereto. From the above description, it is clear that translating pulley 20 relative to guiding member 12, results in horizontal locomotion of a worker tied to snapling equipment 24 across wall 18, whereas vertical locomotion is achieved as in prior art snapling equipment. The term snapling equipment" as used herein in the specification and claims below refers to a set of ropes or bands, pulleys and the like which are typically used while down climbing cliffs and other objects of a vertical nature.

The construction of guiding member 12 may be of various forms wherein first pulley 20 is internal of member 12 as shown in FIG. 1, or alternatively first pulley 20 is external of member 12 (not shown). A suitable guiding member is manufactured under the name KBK by Mannesmann.

In a preferred embodiment guiding member 12 includes a first stoppage mechanism 11 located at first end 13 of guiding member 12 and a second stoppage mechanism 17 located at second end 19 of guiding member 12. Stoppage mechanisms 11 and 13 are for stopping first pulley 20 from sliding off guiding member 12. Each of stoppage mechanisms 11 and 17 may be any implement installed at ends 13 and 19, respectively, of member 12, such as but not limited to a pin, screw, etc., or as shown in FIG. 2, a cover 21.

In a preferred embodiment, device 10 further includes a security cable 26 connected at both ends to guiding member 12, as shown in FIG. 2, or to wall 18 or roof 14 of structure 15 and, a horizontally translating second pulley 28 translatably attached to security cable 26. Similar and in parallel to first pulley 20, second pulley 28 is horizontally translatable relative to security cable 26 and includes a second attachment 30 for securely attaching snapling equipment 24 thereto. Thus, snapling equipment 24 is horizontally translatably attached via pulleys 20 and 28 both to guiding member 12 and to security cable 26, respectively, and is thus safer to use.

Device 10, preferably further includes at least two (e.g., three, as shown in FIG. 2) L-shape supporters 32 connected or integrally formed with guiding member 12. Connecting supporters 32 to guiding member 12 may be effected in various ways, such as for example but not limited to welding or screwing. Each of supporters 32 has a vertical arm 34 and a horizontal arm 36. Vertical arms 34 are vertically disposed against exterior surface 18 of structure 15, whereas horizontal arms 36 are horizontally disposed on roof 14 of structure 15. It should be noted that when the phrase 'at least two L-shape supporters' is used herein in this document it also refers to a situation wherein only one very wide L-shape supporter is used functioning similarly to at least two supporters.

Device 10 preferably further includes at least two press forming mechanisms 38 each attached or integrally formed with one of horizontal arms 36 of one of supporters 32. Attaching press forming mechanisms 38 onto horizontal arms 36 may be effected in various ways, such as for example but not limited to welding or screwing. It should be noted that when the phrase 'at least two press forming mechanisms' is used herein in this document it also refers to a situation wherein only one very wide press forming mechanism is used functioning similarly to at least two press forming mechanisms. As will be emphasized in greater detail below, press forming mechanisms 38 may acquire any suitable shape such as a triangular shape as shown in FIG. 1, an arc shape, a rectangle shape and, as will be appreciated by one ordinarily skilled in the art, press forming mechanisms 38 may also acquire a shape of a pole (not shown), etc. Device 10 further includes at least two straps 40, each of straps 40 has a first end 42 and a second end 44, wherein first ends 42 are connected to guiding member 12 and second ends 44 are connected to any available roof element 46 such as an antenna base, a weight temporarily placed on the roof, etc., such that when an object, typically a worker is lied to snapling equipment 24, each of straps 40 applies a vectorial vertical press onto a corresponding press forming mechanism 38 and thus vertically presses a corresponding horizontal arm 36 onto roof 14 of structure 15, thus securing guiding member 12 onto the edge of roof 14. For connecting straps 40 to guiding member 12, guiding member 12 includes at least two strap attachment mechanisms 52, each is for attaching a first end 42 of one of straps 40. Each of strap attachment mechanisms 52 may acquire various forms such as, but not limited to a ring or a hook attached to guiding member 12, or, as shown in FIG. 1, a hole 54, preferably of a rectangular shape, formed in guiding member 12, to accept one of straps 40. Each of straps 40 is preferably equipped with suitable types of buckles 56 to facilitate attachment to roof element 46 and for length adjustments.

The term 'strap' as used herein in this document and in the claims below refers to any type of cable, wire, rope, etc. Preferably straps 40 are adjustable length straps similar in structure to ones frequently used in back carried school bags.

In a preferred embodiment, each of horizontal arms 36 of L-shape supporters 32 has a rough roof facing surface 48 to increase the friction between roof's 14 surface and arms 36 and thus the stable engagement of device 10 onto structure 15. In yet another preferred embodiment, each of press forming mechanisms has a strap securing mechanism 50. Each of strap securing mechanisms 50 may acquire various forms such as for example but not limited to an oval ring, a rectangular ring, an open oval ring or an open rectangular ring, for securely engaging straps 40 and for preventing its sideways slippage from the corresponding press forming mechanism 38.

In yet another preferred embodiment, guiding member 12 is made of at least two guiding segments 60*a–c* securely connected to one another by for example a secured quick release mechanism 62 as shown in FIG. 2, or by simple pins 63, as shown in FIG. 1. Thus, guiding member 12 may be selected in any suitable length.

The operation of device 10 is very simple. A worker ties himself to snapling equipment 24 and pulls himself up and down, employing the capabilities of equipment 24 for vertical locomotion, and sideways, employing the capabilities of guiding member 12 and first pulley 20 for horizontal locomotion. The weight of the worker and the construction of device 10 having press forming mechanisms 38, L-shape supporters 32 and straps 40, ensures that device 10 is securely attached to roof 15 of structure 14 when device 10 is in use by a worker as described. It will however be appreciated by one ordinarily skilled in the art that both pulley 20 and snapling equipment 24 may be motor operated to facilitate horizontal and vertical locomotion of the worker across and along the exterior of the structure, although for many applications such motors are not required.

Thus, the device for vertical as well as horizontal snapling along and across the exterior surface of a treated structure according to the present invention has advantages over prior art approaches by being simple to install and not expensive, similar to conventional snapling equipment and in contradistinction to scaffolds, yet provides a worker with the ability of both horizontal and vertical locomotion across and along the exterior of the treated structure.

While the invention has been described with respect to a limited number of embodiments, it will be appreciated that many variations, modifications and other applications of the invention may be made.

What is claimed is:

1. A device for vertical as well as horizontal snapling along and across an exterior surface of a structure, the structure having a roof, the roof having an edge and a roof element, the device comprising:

(a) a substantially horizontal guiding member being securable onto the edge of the roof of the structure, said guiding member having a first end and a second end;

(b) a horizontally translating first pulley being translatably attached to said guiding member, said first pulley being horizontally translatable relative to said guiding member, said first pulley including a first attachment;

(c) a snapling equipment attached to said first attachment of said first pulley;

(d) at least two L-shape supporters being connected or integrally formed with said guiding member, each of said at least two supporters having a vertical arm arid a horizontal arm, said vertical arm being vertically disposable against the exterior surface of the structure, said horizontal arm being horizontally disposable on the roof of the structure;

(e) at least two press forming mechanisms, each of said at least two press forming mechanisms being attached or integrally formed with one of said at least two horizontal arms of one of said supporters; and (f) at least two straps, each of said straps having a first end and a second end, said first ends being connected to said guiding member and said second ends being connectible to the roof element, so that when said second ends of said straps are connected to the roof element, said vertical and horizontal arms of said L-shape supporters are disposed against yhe structure and an object is connected to said snapling equipment, each of said at least two straps applies a vectorial vertical press onto said at least two press forming mechanism and thus vertically presses said at least two horizontal arms onto the roof of the structure, thus securing said guiding member onto the edge of the roof.

2. A device as in claim 1, further comprising:

(g) a security cable being connected at both ends to said guiding member; and (h) a horizontally translating second pulley being translatably attached to said security cable, said second pulley being horizontally translatable relative to said security cable, said second pulley including a second attachment for securely attaching said snapling equipment thereto.

3. A device as in claim 1, wherein said guiding member is made of at least two guiding segments securely connected to one another.

4. A device as in claim 3, wherein said secure connection is by a secured quick release mechanism.

5. A device as in claim 1, wherein each of said at least two press forming mechanisms have a shape selected from the group consisting of a triangle, an arc, a rectangle and a pole.

6. A device as in claim 1, wherein each of said horizontal arms of said at least two L-shape supporters has a rough roof facing surface.

7. A device as in claim 1, wherein each of said at least two press forming mechanisms has a strap securing mechanism.

8. A device as in claim 7, wherein said strap securing mechanism is selected from the group consisting of an oval ring, a rectangular ring, an open oval ring and an open rectangular ring.

9. A device as in claim 1, wherein each of said at least two straps is selected from the group consisting of a cable, a wire, a rope and an adjustable length strap.

10. A device as in claim 1, wherein said guiding member includes at least two strap attachment mechanisms each for attaching said first end of one of said at least two straps.

11. A device as in claim 1, wherein said strap attachment mechanisms are selected from the group consisting of a ring attached to said guiding member, a hook attached to said guiding member and a hole formed in said guiding member.

12. A device as in claim 11, wherein said ring and said hole have a rectangular shape.

13. A device as in claim 1, wherein said guiding member includes a first stoppage mechanism located at said first end of said guiding member and a second stoppage mechanism located at said second end of said guiding member for stopping said first pulley, said stoppage mechanisms are for stopping said first pulley from sliding off said guiding member.

* * * * *